US009770118B2

(12) United States Patent
Mountz

(10) Patent No.: US 9,770,118 B2
(45) Date of Patent: Sep. 26, 2017

(54) CHANGING CARRIER FOR A PLAYARD

(71) Applicant: WONDERLAND NURSERYGOODS COMPANY LIMITED, Hong Kong (HK)

(72) Inventor: Jonathan K. Mountz, Elverson, PA (US)

(73) Assignee: WONDERLAND NURSERYGOODS COMPANY LIMITED, Hong Kong (HK)

( * ) Notice: Subject to any disclaimer, the term of this patent is extended or adjusted under 35 U.S.C. 154(b) by 364 days.

(21) Appl. No.: 14/470,472

(22) Filed: Aug. 27, 2014

(65) Prior Publication Data

US 2015/0113728 A1 Apr. 30, 2015

Related U.S. Application Data

(60) Provisional application No. 61/962,104, filed on Oct. 31, 2013.

(51) Int. Cl.

| | |
|---|---|
| ***A47D 7/00*** | (2006.01) |
| ***A47D 13/06*** | (2006.01) |
| ***A47D 5/00*** | (2006.01) |

(52) U.S. Cl.

CPC ..... *A47D 5/00* (2013.01); *A47D 7/00* (2013.01); *A47D 13/06* (2013.01); *A47D 13/063* (2013.01)

(58) Field of Classification Search

CPC ..... A47D 13/06; A47D 13/061; A47D 5/00; A47D 9/00; A47D 9/005; A47D 13/02; A47D 13/025; A47D 13/063; A47D 13/065; A47D 13/066

See application file for complete search history.

(56) References Cited

U.S. PATENT DOCUMENTS

| | | | | |
|---|---|---|---|---|
| 5,381,570 | A * | 1/1995 | Cheng | A47D 13/063 16/329 |
| 5,778,465 | A * | 7/1998 | Myers | A47D 7/04 5/93.1 |
| 6,148,456 | A * | 11/2000 | Tharalson | A47C 29/003 5/11 |
| 6,233,759 | B1 * | 5/2001 | Warner, Jr. | A47D 5/006 5/93.1 |
| 6,543,070 | B2 * | 4/2003 | Longenecker | A47D 5/006 5/655 |
| 6,948,197 | B1 * | 9/2005 | Chen | A47D 5/006 403/97 |

(Continued)

*Primary Examiner* — Nicholas Polito
*Assistant Examiner* — Rahib Zaman
(74) *Attorney, Agent, or Firm* — Hamre, Schumann, Mueller & Larson, P.C.

(57) ABSTRACT

A changing carrier for a playard includes a frame used to be attached detachably to the top of the playard, and a fabric body wrapping around the frame to confine a receiving space within the frame. The frame includes a pair of brackets, each of which is adapted to be connected slidably and detachably to a respective one of two upper side rails of the playard. The frame is movable relative to the playard between a detached position, where each bracket is not connected to the respective upper side rails, and a stop position, where each bracket connects to the respective upper side rail and where the frame abuts against an upper end rail of the playard interconnecting the upper side rails.

19 Claims, 6 Drawing Sheets

(56) References Cited

U.S. PATENT DOCUMENTS 7,228,575 B2 * 6/2007 Chen ..... A47D 5/00 5/93.2
7,343,634 B2 * 3/2008 Song ..... A47D 13/063 5/98.1
7,458,114 B2 * 12/2008 Troutman ..... A47D 5/00 24/460
7,581,269 B2 * 9/2009 Chen ..... A47D 13/063 5/655
7,908,686 B2 * 3/2011 Clapper ..... A47D 5/00 5/655
7,950,081 B2 * 5/2011 Chen ..... A47D 5/006 5/93.1
8,006,326 B2 * 8/2011 Thomas ..... A47D 5/00 5/93.1
8,011,036 B2 * 9/2011 Tuckey ..... A47D 5/00 5/93.1
8,522,374 B2 * 9/2013 Sousa ..... A47D 5/00 5/2.1
8,544,125 B2 * 10/2013 Greger ..... A47D 9/00 5/93.1
8,677,527 B2 * 3/2014 Hartenstine ..... A47D 9/005 5/93.1
8,739,331 B2 * 6/2014 Gillett ..... A47D 13/00 5/655
8,943,622 B2 * 2/2015 Saint ..... A47D 5/00 5/93.1
8,973,180 B2 * 3/2015 Zeng ..... A47D 5/006 5/93.1
8,997,277 B2 * 4/2015 Thomas ..... A47D 5/00 5/414
9,078,530 B2 * 7/2015 Ingram ..... A47D 13/06
9,101,226 B1 * 8/2015 Hartenstine ..... A47D 5/006
9,351,588 B2 * 5/2016 Burns ..... A47D 7/04
2004/0261174 A1 * 12/2004 DeHart ..... A47D 5/00 5/93.1
2006/0253980 A1 * 11/2006 Paesang ..... A47D 7/04 5/99.1
2008/0229982 A1 * 9/2008 Miller ..... A47D 5/00 108/49
2012/0037869 A1 * 2/2012 Fiore, III ..... A47D 9/005 256/25
2012/0204347 A1 * 8/2012 Li ..... A47D 5/006 5/93.1
2013/0086750 A1 * 4/2013 Cheng ..... A47D 13/063 5/655
2013/0119333 A1 * 5/2013 Gillett ..... A47D 13/00 256/25
2013/0318709 A1 * 12/2013 Bellows ..... A47D 9/02 5/101
2013/0326808 A1 * 12/2013 Saint ..... A47D 5/00 5/93.1

* cited by examiner

CHANGING CARRIER FOR A PLAYARD

CROSS-REFERENCE TO RELATED APPLICATION

This application claims priority to U.S. Patent Provisional Application No. 61/962,104, filed on Oct. 31, 2013.

FIELD OF THE INVENTION

The invention relates to a playard, and more particularly to a changing carrier for a playard.

BACKGROUND OF THE INVENTION

A playard generally includes side walls and a bottom floor defining an enclosed play area for young children. Installing a bassinet accessory in a playard for providing a sleeping surface is known to enhance the functionality of the playard. The bassinet accessory is generally suitable for an infant in the age range of a newborn up to six months. With the bassinet accessory removed, the playard can foe used for a child up to about 2 to 3 years old. However, diapers are to be changed multiple times a day for a young child. In this case, since the top frame rails of the playard are elevated from the bottom floor for safety purposes, the playard does not facilitate easy diaper change. Therefore, there is still room for improvement in the above techniques.

SUMMARY OF THE INVENTION

Therefore, an object of the present invention is to provide a changing carrier for a playard that can overcome the aforesaid drawback of the prior art.

According to one aspect of the present invention, there is provided a changing carrier for a playard. The playard includes a pair of upper side rails, and an upper end rail interconnecting the upper side rails. A corner between the upper end rail and each of the upper side rails is suspended. The changing carrier of this invention comprises:

a frame adapted to be attached detachably to the top of the playard, the frame including a pair of brackets, each of which is adapted to be connected slidably and detachably to a respective one of the upper side rails of the playard; and a fabric body wrapping around the frame to confine a receiving space within the frame.

The frame is movable relative to the playard between a detached position, where each of the brackets is not connected to the respective one of the upper side rails such that the changing carrier is allowed to be detached from the playard, and a stop position, where each of the brackets connects to the respective one of the upper side rails and where the frame abuts against the upper end rail of the playard.

According to another aspect of the present invention, a changing carrier and playard combination comprises:

a playard including a pair of upper side rails, and an upper end rail interconnecting the upper side rail members, a corner between the upper end rail and each of the upper side rails being suspended; and a changing carrier including a frame attached detachably to the top of the playard, the frame including a pair of brackets, each of which is connected slidably and detachably to a respective one of the upper side rails of the playard, and a fabric body wrapping around the frame to confine a receiving space within the frame.

The frame of the changing carrier is movable relative to the playard between a detached position, where each of the brackets is not connected to the respective one of the upper side rails of the playard such that the changing carrier is allowed to be detached from the playard, and a stop position, where each of the brackets connects to the respective one of the upper side rails of the playard and where the frame abuts against the upper end rail of the playard.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
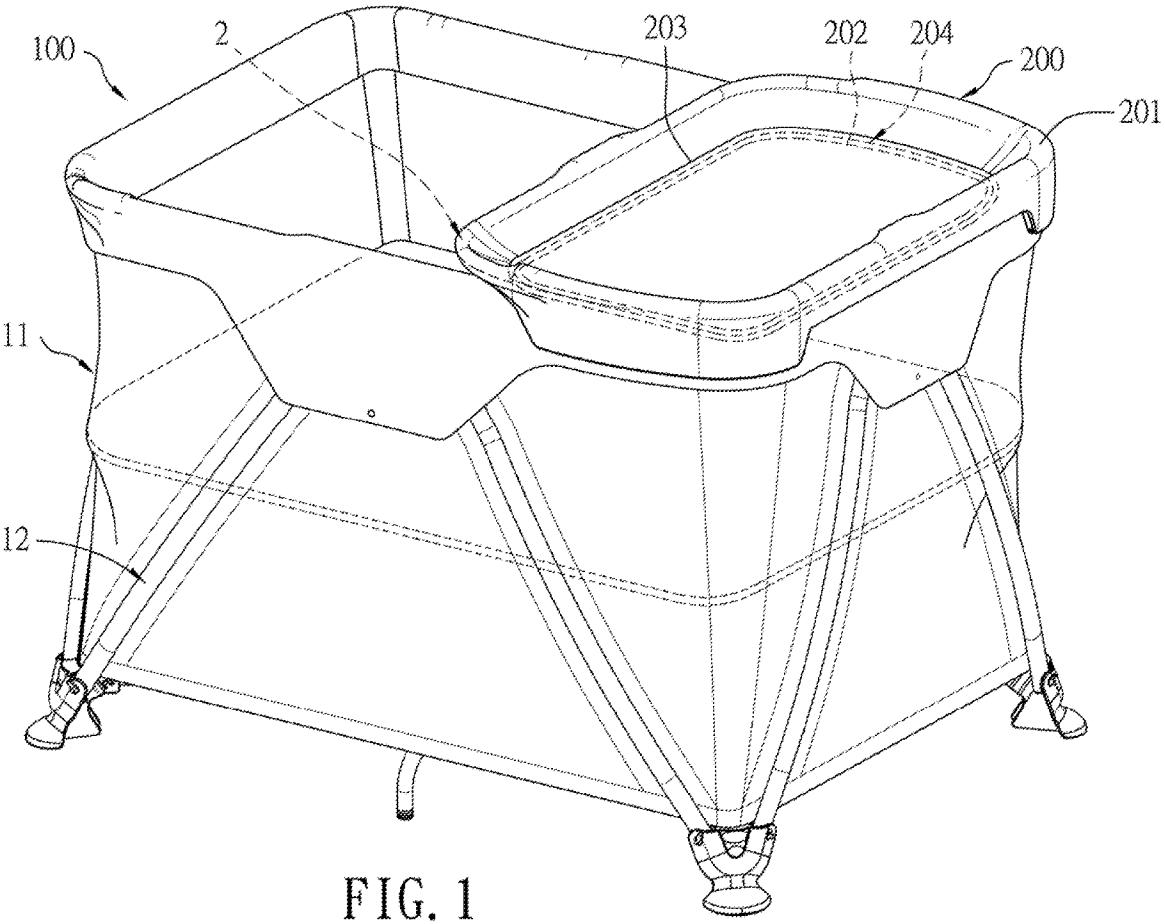
FIG. 1 is a perspective view showing the embodiment of a changing carrier and playard combination according to the present invention when in use.
Figure 2:
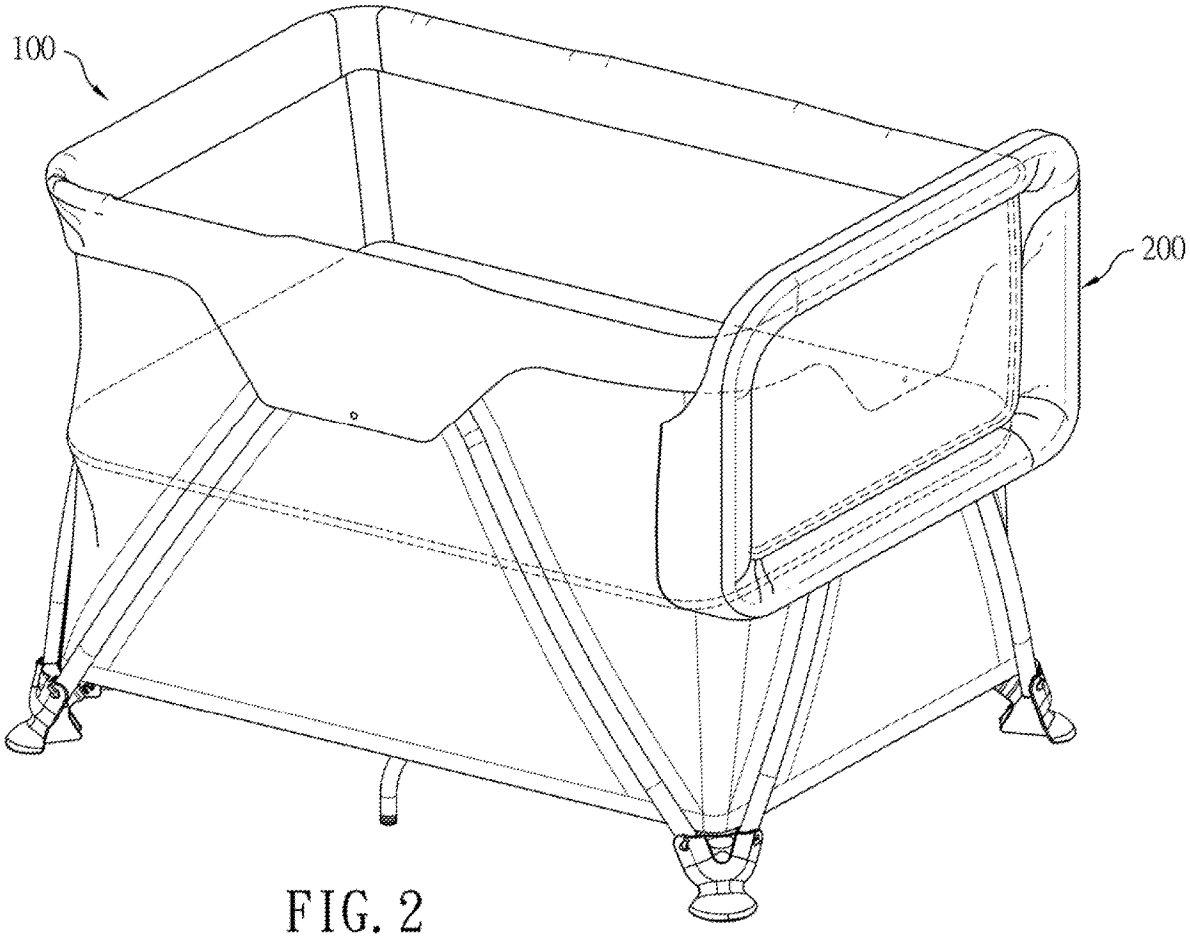
FIG. 2 is a perspective view illustrating the embodiment when a changing carrier is hung on the side of a playard for storage.

Referring to FIGS. 1 and 2, the embodiment of a changing carrier and playard combination according to the present invention is shown to include a playard 100 and a changing carrier 200. The playard 100 includes a foldable frame structure 12, and a fabric enclosure 11 connected to the frame structure 12.

Figure 3:
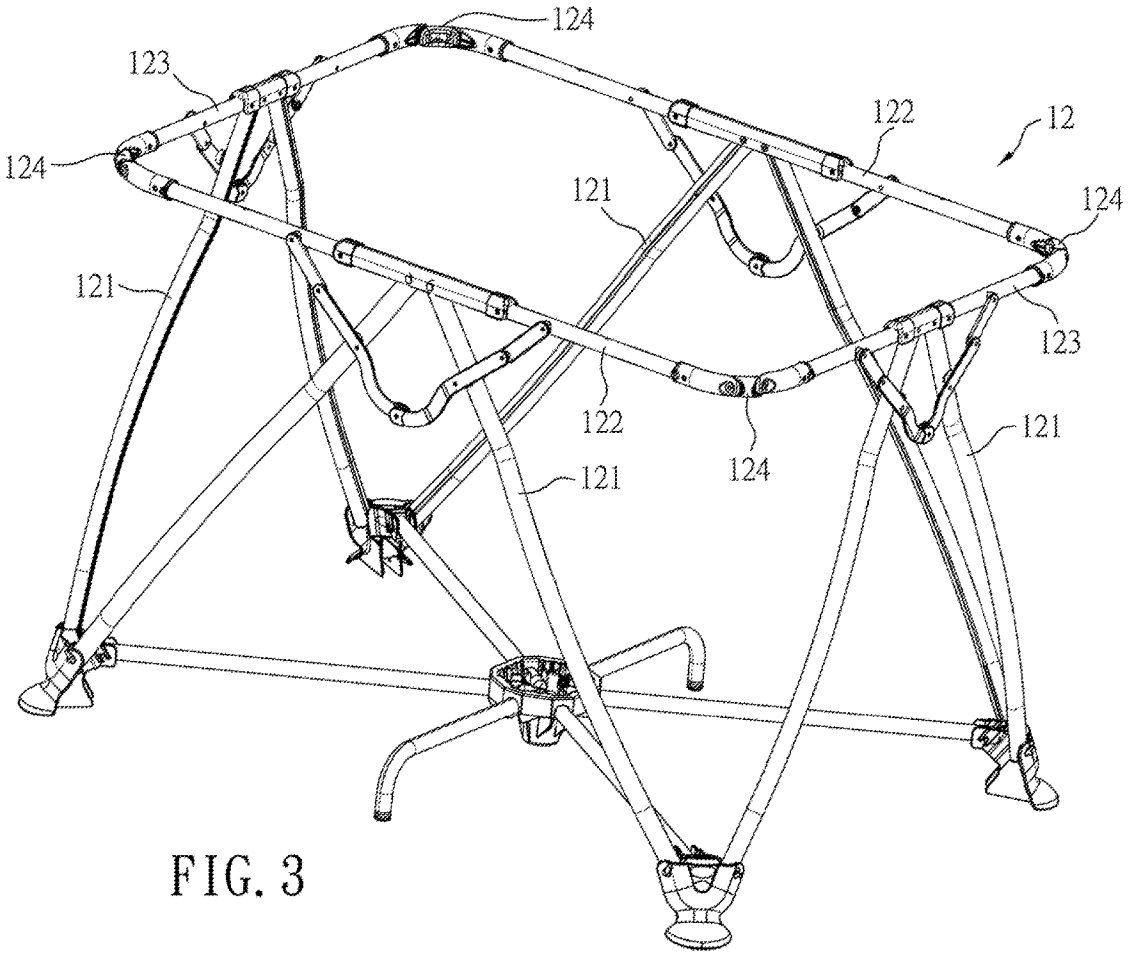
FIG. 3 is a perspective view showing a frame structure of the playard of the embodiment.

Referring to FIG. 3, the frame structure 12 of the playard 100 includes a rectangular upper rail assembly and four inverted V-shaped legs 121. The upper rail assembly has a pair of upper side rails 122, a pair of upper end rails 123 interconnecting the upper side rails 122. Each of the upper side rails 122 and the upper end rails 123 is connected to the top of a respective inverted V-shaped leg 121. The upper rail assembly further has four corners 124, each of which is formed between a corresponding adjacent, pair of the upper side rail 122 and the upper end rail 123, and is suspended, i.e., there is no vertical corner column or support rod connected to the corner 124.

Figure 4:
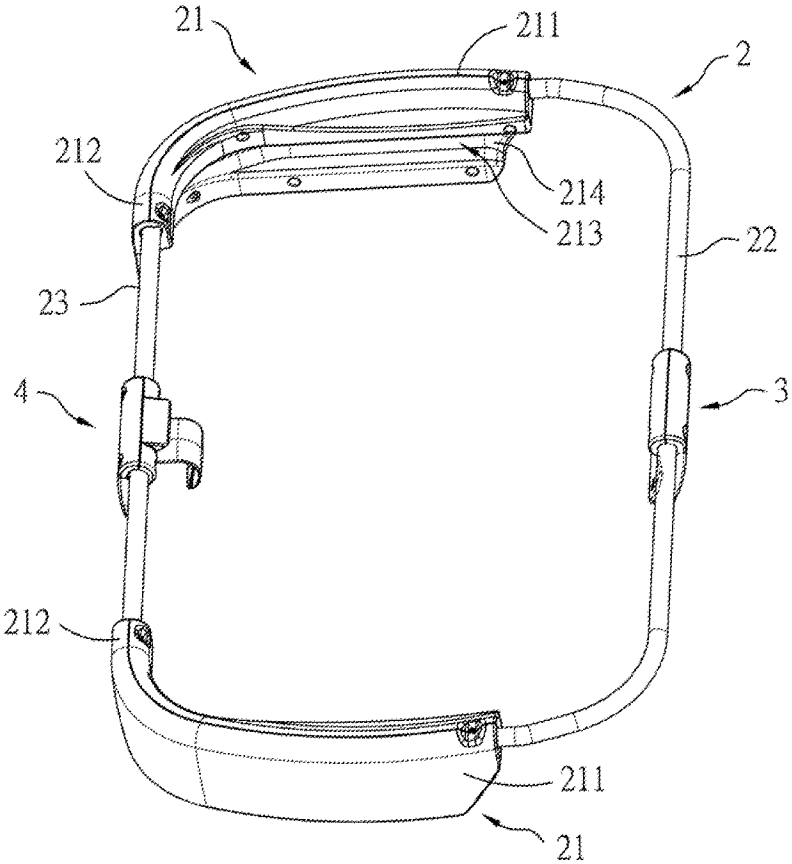
FIG. 4 is a perspective view showing the changing carrier of the embodiment without a fabric body.
Figure 5:
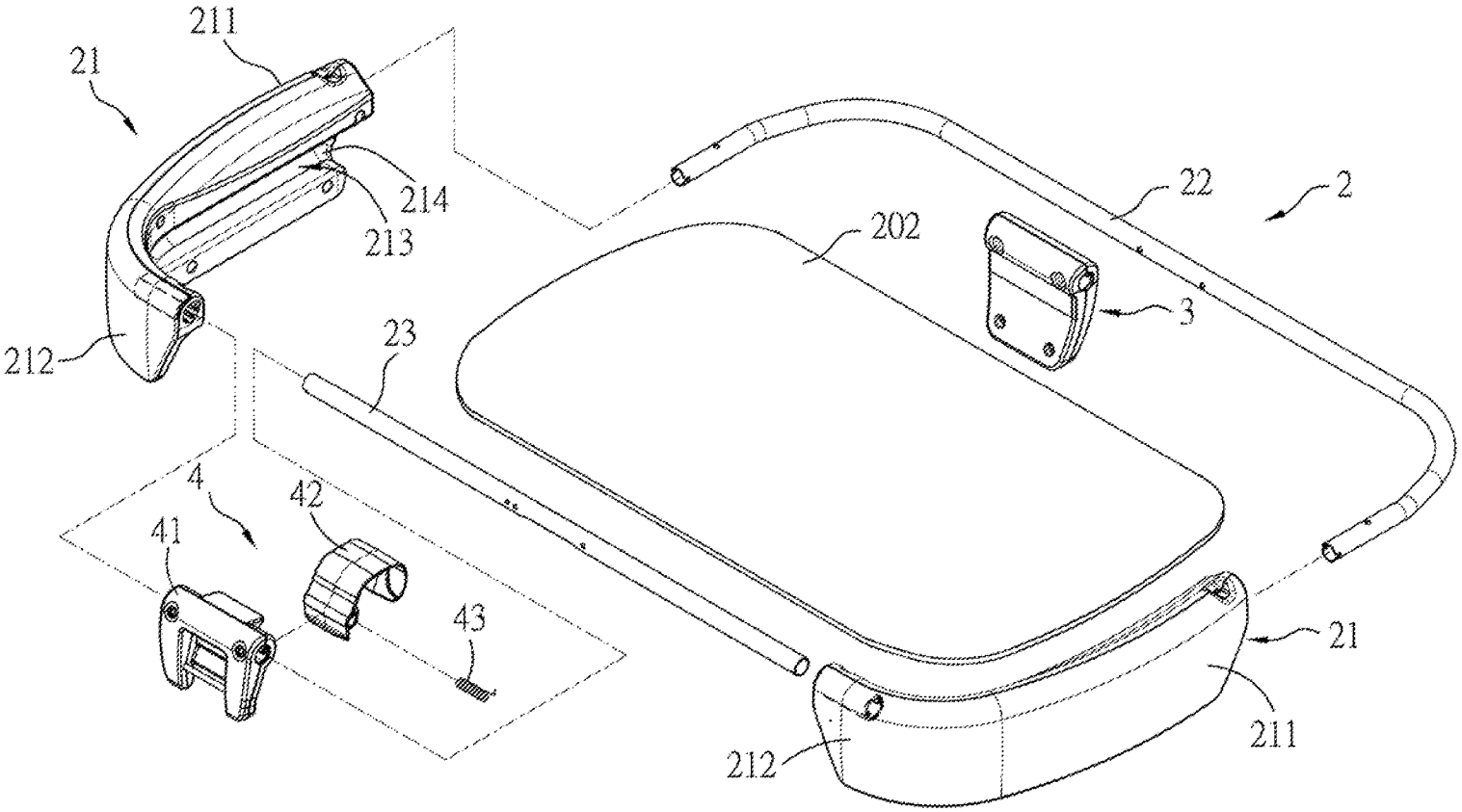
FIG. 5 is an exploded perspective view of the changing carrier without the fabric body.

Referring to FIGS. 1, 4 and 5, the changing carrier 200 includes a looped frame 2, a fabric body 201, a curved support block 3 and a locking mechanism 4.

The fabric body 201 wraps around the frame 2 to confine a receiving space 203 within the frame 2 for receiving a child, and has a bottom side that is formed with a pouch 204. In this embodiment, the changing carrier 200 further includes a bottom board 202 that is removably received in the pouch 204 (see FIG. 1).

Figure 6:
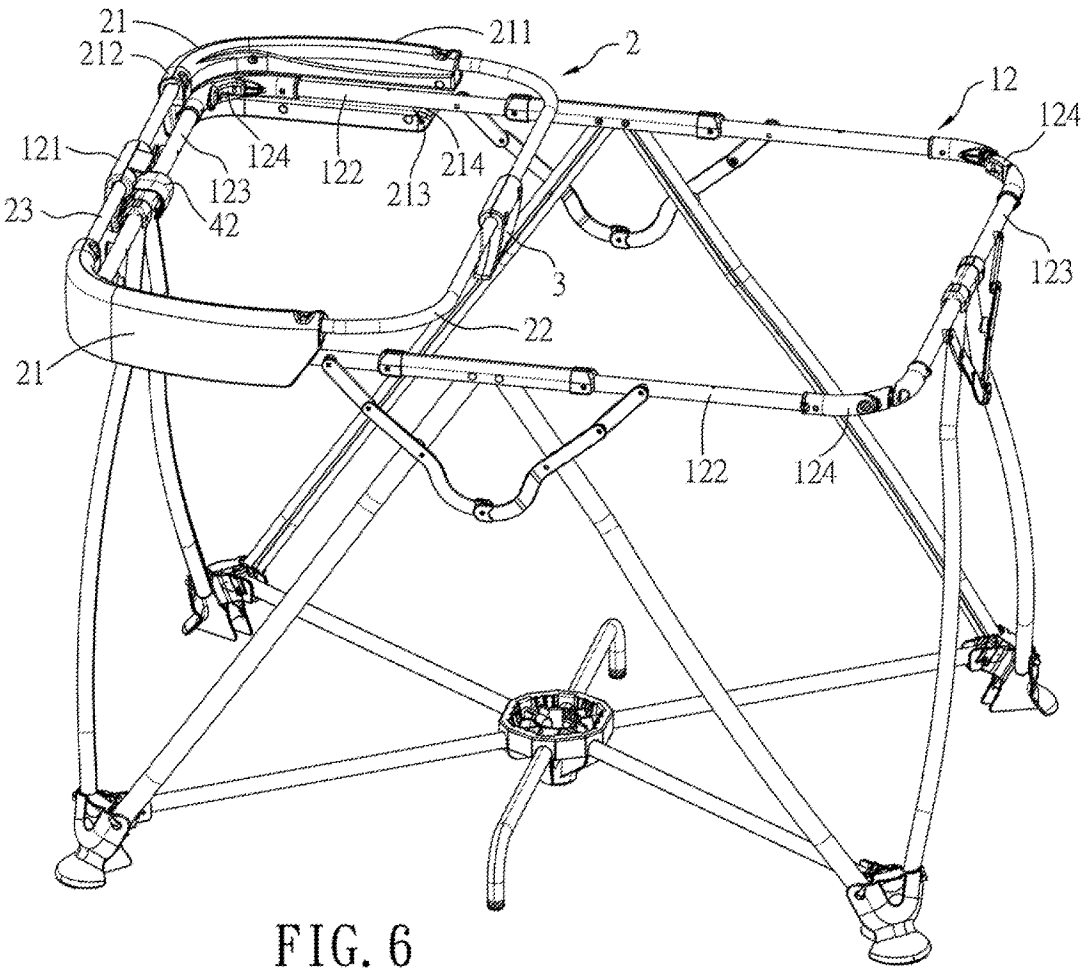
FIG. 6 is a perspective view illustrating the embodiment without the fabric body of the changing carrier and a fabric enclosure of the playard when the frame of the changing carrier is in the stop position.

The frame 2 is attached detachably to the top of the frame structure 12 of the playard 100 (see FIG. 6). The frame 2 is horizontally movable relative to the frame structure 12 of the playard 100 between a detached position and a stop position. In this embodiment, the frame 2 includes a pair of substantially L-shaped brackets 21, a U-shaped first rod 22 and a straight second rod 23. Each bracket 21 is used to be connected slidably and detachably to a respective upper side rail 122 of the frame structure 12. In this embodiment, each bracket 21 has a first arm portion 211 that extends along the respective upper side rail 122 of the frame structure 12 and that has an inner side surface formed with a slide groove 213, which engages fittingly and movably the respective upper side rail 122 of the frame structure 12, and a second arm portion 212 that is connected integrally to and shorter than the first arm portion 211 and that extends toward the other bracket 21. The first rod 22 interconnects the first arm portions 211 of the brackets 21. The second rod 23 interconnects the second arm portions 212 of the brackets 21. It is noted that the slid groove 213 in each bracket 21 is defined by a C-shaped engagement wall 214 of the first arm portion 211 (see FIG. 4) that fittingly surrounds the respective upper side rod 122 of the frame structure 12 so as to prevent upward or downward movement of the frame 2 relative to the frame structure 12.

When the frame 2 is in the detached position, each bracket 21 is not connected to the respective upper side rail 122 of the frame structure 12 such that the changing carrier 200 is allowed to be detached from the playard 100. When assembling the changing carrier 200 to the playard 100, i.e., moving the frame 2 from the detached position to the stop position, at the outset, the frame 2 is brought near one upper end rail 123, for example, the left one shown in FIG. 6, in a manner that the first rod 22 of the frame 2 is disposed above the upper rail assembly of the frame structure 12 and that the slide grooves 213 in the brackets 21 are aligned respectively with the two corresponding suspended corners 124 of the upper rail assembly. Then, the frame 2 is pushed toward the center of the playard 100 such that the two corresponding suspended corners 124 of the upper rail assembly enter respectively the slide grooves 213 in the brackets 21 so as to guide the upper side rails 122 to engage respectively the slide grooves 213 in the brackets 21, thereby attaching the frame 2 to the frame structure 12. When the frame 2 is in the stop position, for each bracket 21, the first arm portion 211 connects to the respective upper side rail 122 while the second arm portion 212 abuts against said one upper end rail 123 of the frame structure 12, as shown in FIG. 6. During assembly of the changing carrier 200 to the playard 100, the bottom side of the fabric body 201 with the bottom board 202 is guided and raised by said one upper end rail 123 of the frame structure 12 of the playard 100 to pass thereover as the frame 2 moves toward the stop position until the bottom side of the fabric body 201 fully drops in the playard 100 when the frame 2 reaches the stop position.

Referring again to FIGS. 5 and 6, in this embodiment, the curved supporting block 3 permits the first rod 22 of the frame 2 to extend therethrough, and is connected to the first rod 22 of the frame 2. The supporting block 3 extends downwardly and inwardly, and cooperates with the brackets 21 to serve as a foot stand structure when the changing carrier 200 is detached from the playard 100 for use alone. On the other hand, when not in use, the changing carrier 200 can be hung vertically on one of the upper side rails 122 and the upper end rails 123 of the frame structure with the supporting block 3 for storage purposes (see FIG. 2). In this case, the supporting block 3 functions as a hook.

Referring again to FIGS. 5 and 6, the locking mechanism 4 is used to releasably connect the second rod 23 of the frame 2 and said one of the upper end rails 123 of the frame structure 12 that abuts against the second arm portions 212 of the brackets 21 of the frame 2 to lock the frame 2 in the stop position. In this embodiment, the locking mechanism 4 includes a connecting seat 41, a hook body 42 and a biasing member 43. The connecting seat 41 permits the second rod 23 of the frame 2 to extend therethrough, and is connected and fixed to the second rod 23 of the frame 2. The hook body 42 is connected pivotally to the connecting seat 41, and is movable relative to the connecting seat 41 between an unlocking position, and a locking position, where the hook body 42 is used to hook said one upper end rail 123 of the playard 100 when the frame 2 is in the stop position. The biasing member 43, such as a torsion spring, is disposed in the connecting seat 41 for biasing the hook body 42 to move toward the locking position.

To sum up, due to the presence of the locking mechanism 4, the changing carrier 200 of this invention can be securely attached to the top of the playard 100 for providing a diaper changing platform. When the changing carrier 200 is not in use, it can be easily removed from the playard 100 and then stored on the side of the playard 100. In addition, the changing carrier 200 can also be used as a stand-alone unit on the floor or on a table, or even for travel.

While the present invention has been described in connection with what is considered the most practical embodiment, it is understood that this invention is not limited to the disclosed embodiment but is intended to cover various arrangements included within the spirit and scope of the broadest interpretation so as to encompass ail such modifications and equivalent arrangements.

What is claimed is:

1. A changing carrier for a playard, the playard including a pair of upper side rails, an upper end rail interconnecting the upper side rails, and corners between the upper end rail and each of the upper side rails being suspended, said changing carrier comprising: a frame attached detachably to the top of the playard, said frame including a pair of brackets, each bracket being detachably connected to a respective one of the upper side rails of the playard; and a fabric body wrapping around said frame to confine a receiving space within said frame, wherein said frame is movable relative to the playard between a detached position, where each of said brackets is not connected to the respective one of the upper side rails such that said changing carrier is allowed to detach from the playard, and a stop position, where each of said brackets is connected to the respective one of the upper side rails and where said frame abuts against the upper end rail of the playard, wherein each bracket is configured to slideabiy attach to and slideably detach from the respective one of the upper side rails of the playard by sliding along a length of the respective one of the upper side rails, and wherein each bracket is aligned with a corresponding one of the corners of the playard to be slideably attached to the respective one of the upper side rails of the playard.

2. The changing carrier as claimed in claim 1, wherein each of said brackets of said frame has a slide groove that engages fittingly and movably the respective one of the upper side rails of the playard.

3. The changing carrier as claimed in claim 2, wherein said slide groove in each of said brackets is defined by a C-shaped engagement wall that fittingly surrounds the respective one of the upper side rail of the playard so as to prevent upward or downward movement of said frame relative to the playard.

4. The changing carrier as claimed in claim 2, wherein:

each of said brackets of said frame is substantially L-shaped, and has a first arm portion that extends along the respective one of the upper side rails of the playard and that has an inner side surface formed with said slide groove, and a second arm portion that is connected integrally to said first arm portion and that extends toward the other one of said brackets; and when said frame is in the stop position, said second arm portions of said brackets abut against the upper end rail of the playard.

5. The changing carrier as claimed in claim 4, wherein:

said frame further includes a first rod interconnecting said first arm portions of said brackets, and a second rod interconnecting said second arm portions of said brackets; and during movement of said frame from the detached position to the stop position, said first rod is disposed above the playard.

6. The changing carrier as claimed in claim 1, further comprising a curved supporting block that is connected to said frame and that cooperates with said brackets to serve as a foot stand structure when said changing carrier is detached from the playard for use alone, said changing carrier being hung vertically on one of the upper end rail and the upper side rails of the playard with said curved supporting block when not in use.

7. The changing carrier as claimed in claim 1, further comprising a locking mechanism releasably connecting said frame and the upper end rail of the playard to lock the frame in the stop position.

8. The changing carrier as claimed in claim 7, wherein said locking mechanism includes:

a connecting seat connected and fixed to said frame;

a hook body connected pivotally to said connecting seat and movable relative to said connecting seat between an unlocking position, and a locking position, where said hook body is used to hook the upper end rail of the playard when said frame is in the stop position; and a biasing member for biasing said hook body to move toward the locking position.

9. The changing carrier as claimed in claim 1, wherein said fabric body has a bottom side that is formed with a pouch, said changing carrier further comprising a bottom board that is removably received in said pouch in said fabric body.

10. A changing carrier and playard combination comprising: a playard including a frame structure that includes a pair of upper side rails, an upper end rail interconnecting said upper side rails, and corners between said upper end rail and each of said upper side rails being suspended; and a changing carrier including: a frame attached detachably to the top of said playard, said frame including a pair of brackets, each bracket being detachably connected to a respective one of said upper side rails of said playard, and a fabric body wrapping around said frame to confine a receiving space within said frame, wherein said frame of said changing carrier is movable relative to said playard between a detached position, where each of said brackets is not connected to the respective one of said upper side rails of said playard such that said changing carrier is allowed to detach from said playard, and a stop position, where each of said brackets is connected to the respective one of said upper side rails of said playard and where said frame abuts against said upper end rail of said playard, wherein each bracket is configured to slideably attach to and slideably detach from the respective one of the upper side rails of the playard by sliding along a length of the respective one of the upper side rails, and wherein each bracket is aligned with a corresponding one of the corners of the playard to be slideably attached to the respective one of the upper side rails of the playard.

11. The changing carrier and playard combination as claimed in claim 10, wherein each of said brackets of said frame of said changing carrier has a slide groove that engages fittingly and movably the respective one of said upper side rails of said playard.

12. The changing carrier and playard combination as claimed in claim 11, wherein said slide groove in each of said brackets of said frame is defined by a C-shaped engagement wall that fittingly surrounds the respective one of said upper side rail of said playard so as to prevent upward or downward movement of said frame relative to said playard.

13. The changing carrier and playard combination as claimed in claim 11, wherein:

each of said brackets of said frame of said changing carrier is substantially L-shaped, and has a first arm portion that extends along the respective one of said upper side rails of said playard and that has an inner side surface formed with said slide groove, and a second arm portion that is connected integrally to said first arm portion and that extends toward the other one of said brackets; and when said frame is in the stop position, said second arm portions of said brackets abut against said upper end rail of said playard.

14. The changing carrier and playard combination as claimed in claim 13, wherein:

said frame of said changing carrier further includes a first rod interconnecting said first arm portions of said brackets, and a second rod interconnecting said second arm portions of said brackets; and during movement of said frame from the detached position to the stop position, said first rod is disposed above said playard.

15. The changing carrier and playard combination as claimed in claim 10, wherein said changing carrier further includes a curved supporting block that is connected to said frame and that cooperates with said brackets to serve as a foot stand structure when said changing carrier is detached from said playard for use alone, said changing carrier being hung vertically on one of the upper end rail and said upper side rails of the playard with said curved supporting block when not in use.

16. The changing carrier and playard combination as claimed in claim 10, wherein said changing carrier further includes a locking mechanism for releasably connecting said frame and said upper end rail of said playard to lock said frame in the stop position.

17. The changing carrier and playard combination as claimed in claim 16, wherein said locking mechanism of said changing carrier includes:

a connecting seat connected and fixed to said frame;

a hook body connected pivotally to said connecting seat and movable relative to said connecting seat between an unlocking position, and a locking position, where said hook body hooks said upper end rail of said playard when said frame of said changing carrier is in the stop position; and a biasing member for biasing said hook body to move toward the locking position.

18. The changing carrier and playard combination as claimed in claim 10, wherein:

said fabric body of said changing carrier has a bottom side that is formed with a pouch; and said changing carrier further includes a bottom board that is removably received in said pouch in said fabric body.

19. The changing carrier and playard combination as claimed in claim 10, wherein said frame structure of said playard further includes a plurality of inverted V-shaped legs, each of said upper side rails and said upper end rail being connected to the top of a corresponding one of said inverted V-shaped legs.

* * * * *